US007856976B2

(12) United States Patent
Mueller

(10) Patent No.: US 7,856,976 B2
(45) Date of Patent: Dec. 28, 2010

(54) GAS MASK WITH DRINKING DEVICE

(75) Inventor: Ruediger Mueller, Stockelsdorf (DE)

(73) Assignee: Drager Safety AG & Co. KGaA, Lübeck (DE)

( * ) Notice: Subject to any disclaimer, the term of this patent is extended or adjusted under 35 U.S.C. 154(b) by 675 days.

(21) Appl. No.: 11/739,843

(22) Filed: Apr. 25, 2007

(65) Prior Publication Data

US 2008/0011295 A1 Jan. 17, 2008

(30) Foreign Application Priority Data

Jul. 14, 2006 (DE) ..... 10 2006 032 801

(51) Int. Cl.
*A62B 18/08* (2006.01)

(52) U.S. Cl. ..... 128/202.15; 128/206.21; 128/201.22; 128/201.23; 128/201.26

(58) Field of Classification Search ..... 128/202.15, 128/206.21–207.13; 215/216, 220, 224–225, 215/228, 229, 237, 258, 296, 306; 2/410, 2/8.6, 422, 173, 209.13, 209.14
See application file for complete search history.

(56) References Cited

U.S. PATENT DOCUMENTS

| | | | | |
|---|---|---|---|---|
| 1,366,437 | A * | 1/1921 | Wagenhorst | 128/202.15 |
| 3,635,217 | A * | 1/1972 | Potash | 128/201.19 |
| 4,230,345 | A | 10/1980 | Boelkins | |
| 4,841,963 | A * | 6/1989 | Vandeputte | 128/202.15 |
| 5,057,093 | A * | 10/1991 | Clegg et al. | 604/535 |
| 5,060,833 | A | 10/1991 | Edison et al. | |
| 6,615,829 | B2 * | 9/2003 | Horn et al. | 128/202.15 |

FOREIGN PATENT DOCUMENTS

| | | |
|---|---|---|
| DE | 1 912 780 | 8/1965 |
| GB | 513 769 | 10/1939 |

* cited by examiner

*Primary Examiner*—Danton DeMille
*Assistant Examiner*—Valerie Skorupa
(74) *Attorney, Agent, or Firm*—McGlew and Tuttle, P.C.

(57) ABSTRACT

A gas mask with device for supplying a liquid into the interior space of the gas mask includes a feed tube (6) for drinking liquid that can be fastened to the mask body of the gas mask (3) in a simple manner. A circumferential bead (10) with holes (11), into which a closing plug (8) on the gas mask (3) can be inserted, is provided on the feed tube (6).

20 Claims, 2 Drawing Sheets

GAS MASK WITH DRINKING DEVICE

CROSS REFERENCE TO RELATED APPLICATIONS

This application claims the benefit of priority under 35 U.S.C. §119 of German Patent Application DE 10 2006 032 801.9 filed Jul. 14, 2006, the entire contents of which are incorporated herein by reference.

FIELD OF THE INVENTION

The present invention pertains to a device for feeding a liquid into the interior space of a gas mask.

BACKGROUND OF THE INVENTION

A device of the type mentioned has become known from DE 19 12 780 U. An opening for inserting a feed tube into the interior space of the mask is located on the mask body of the gas mask. The opening consists of a flange running around on the outside and rubber disks, which are arranged in the middle and are provided with slots rotated in relation to one another, so that the rubber disks close the opening when the feed tube is pulled out. A flexible band with a closing plug, which can be plugged into the opening, is located at the flange. To insert the feed tube, the closing plug is first pulled off from the flange and the feed tube is then pushed into the opening. The rubber disks now bulge inwardly and the feed tube can be pushed forward into the interior space of the mask through the slots.

The feed tube is used to supply the user of the mask with liquid and food.

The drawback of the prior-art device is that the feed tube can be accidentally pulled out of the opening.

A drinking connection for a gas mask, in which the feed tube has a circumferential bead, which is pushed into an elastomer mount, is known from GB-PS 513 769. The feed tube is fixed to a certain extent in relation to the gas mask by the bead pushed into the elastomer mount.

SUMMARY OF THE INVENTION

The basic object of the present invention is to improve a device of the type mentioned such that the feed tube is fixed to the mask body in a simple manner.

According to the invention, a device and a gas mask with the device is provided for supplying a liquid into the interior space of a gas mask. The gas mask includes a feed opening on the gas mask. A closing plug is provided to be connected to the gas mask via a flexible part for closing the feed opening. A feed tube is provided which can be inserted into the feed opening. A connection means is provided on the feed tube, which connection means is designed for connection to the closing plug.

The connection means may advantageously be provided as a bead with a hole for receiving the closing plug. A non-return valve may be present in the area of the feed tube. The feed tube may advantageously be designed for connection to a drinking container or a pressurized gas source, preferably an oxygen source. The feed tube may be provided with a plug-in connection.

The advantage of the present invention essentially relates to the closing plug for the feed opening, which plug is arranged on the gas mask anyway, is used to fix the feed tube in relation to the gas mask. A circumferential bead with a hole, into which the closing plug can be inserted, is provided for this purpose on the feed tube. Mechanical fixation of the feed tube in relation to the gas mask is achieved as a result, and the load-bearing capacity of the fixation is determined by the flexible band, to which the closing plug is fastened.

A hose connection, which can be connected either to a drinking container or a pressurized gas source, preferably an oxygen source, is provided on the feed tube. It is also possible to feed breathing gas into the interior space of the mask, besides the feeding of liquid.

It is especially advantageous to provide the feed tube with a plug-in connection, so that this can be directly connected to a so-called "Camelbak®" drinking container. To prevent drinking liquid from flowing back into the reservoir, the plug-in connection may additionally also be provided with a non-return valve.

An exemplary embodiment of the present invention is shown in the drawings and will be explained in greater detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
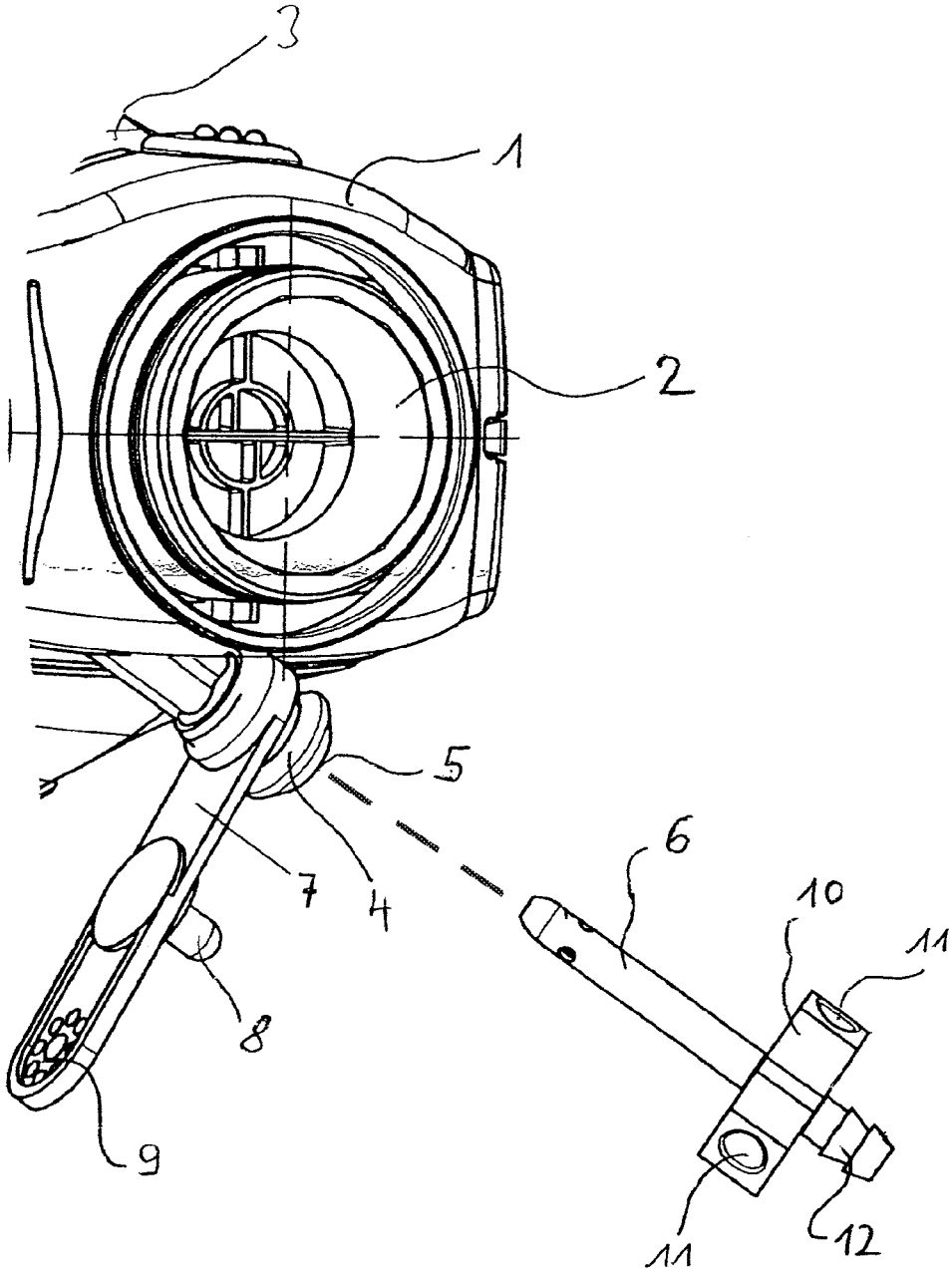
FIG. 1 is a detail of a connection housing on a gas mask with a drinking connection.

Referring to the drawings in particular, FIG. 1 shows a detail of a connection housing 1 with a breathing connection 2 on a gas mask 3, which is not shown more specifically. A drinking connection 4 with a feed opening 5 for a feed tube 6 is located on the connection housing 1. A flexible band 7 with a cylindrical closing plug 8 is fastened to the drinking connection 4, and the feed opening 5 can be blocked with the closing plug 8. The closing plug 8 can be pulled out of the feed opening 5 by means of a strap 9 on the flexible band 7.

The feed tube 6 has a circumferential bead 10 with holes 11 and a hose connection 12, with which the connection to a drinking container, not shown more specifically here, can be established. The holes 11 are dimensioned in terms of the diameter such that the closing plug 8 can be plugged into the hole 11 when the feed tube 6 has been pushed into the feed opening 5 up to the bead 10.

As an alternative, the hose connection 12 may also be used to feed oxygen into the gas mask 3.

Figure 2:
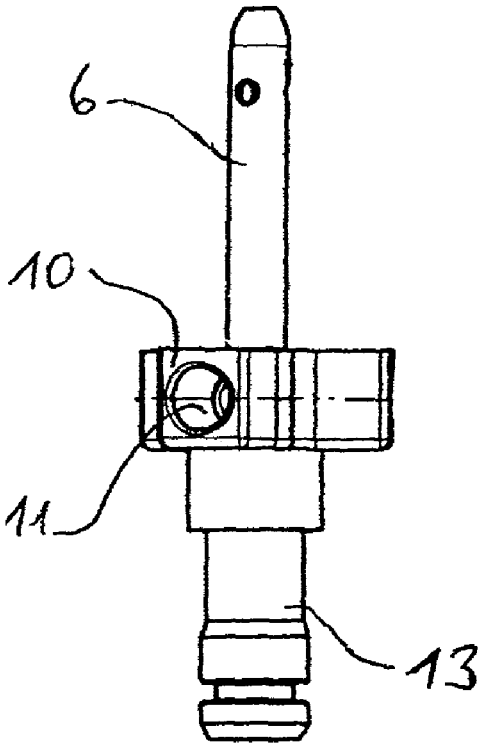
FIG. 2 is a feed tube with a plug-in connection.

FIG. 2 illustrates a feed tube 6 with a plug-in connection 13 for the direct connection of a drinking container, not shown more specifically, for example, a CamelBak® drinking container.

Figure 3:
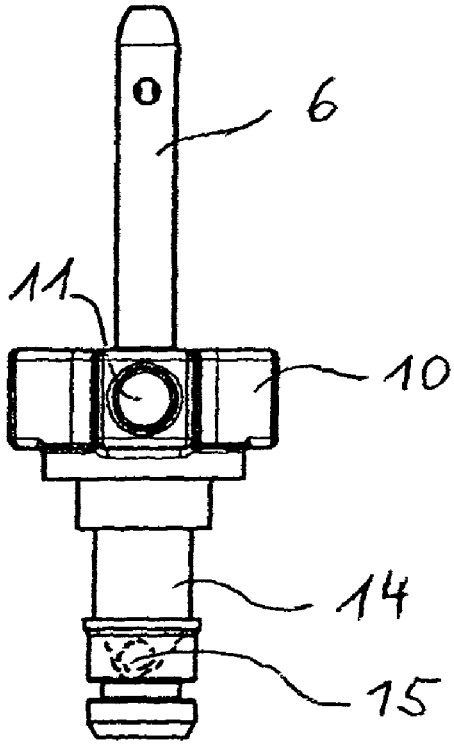
FIG. 3 is a feed tube according to FIG. 2 with a non-return valve.

Compared to the plug-in connection 13 according to FIG. 2, the plug-in connection 14 corresponding to FIG. 3 also contains a non-return valve 15 in order to prevent drinking liquid from flowing back into the drinking container.

The closing plug 8 for the feed opening may be used to fix the feed tube 6 in relation to the gas mask 3, such that the former does not separate from the latter. A mechanical fixation of the feed tube 6 in relation to the gas mask 3 is achieved as a result because the flexible band 7, the closing plug 8, and the circumferential bead or connector 10 form a load bearing structure that mechanically fixes the feed tube 6 to the mask body 3 when the closing plug 8 is connected to the circumferential bead 10. The load-bearing capacity of the fixation is determined by the flexible band 7, to which the closing plug 8 is fastened because a holding force gets transferred from the mask body 3 to the flexible band 7, then to the closing plug 8, then to the circumferential bead 10 and then to the feed tube 6, when the closing plug 8 is connected to the circumferential bead 10 on the feed tube 6. This also allows better use of the hose connection 12, which can be connected either to a drinking container or a pressurized gas source, preferably an oxygen source with this connection site being supported by the mechanical fixation.

While specific embodiments of the invention have been shown and described in detail to illustrate the application of the principles of the invention, it will be understood that the invention may be embodied otherwise without departing from such principles.

What is claimed is:

1. A gas mask having a device for supplying a liquid into an interior space of the gas mask, the device comprising:

a feed opening on said gas mask;

a closing plug connected to said gas mask via a flexible part for directly closing said feed opening;

a feed tube with an insertion portion for insertion into said feed opening; and a connection means on said feed tube for maintaining a connection of said feed tube to said closing plug, said connection means being separate structure than said insertion portion of said feed tube.

2. A gas mask in accordance with claim 1, wherein said connection means is a bead with a hole for receiving said closing plug.

3. A gas mask in accordance with claim 1, wherein a non-return valve is provided in the area of said feed tube.

4. A gas mask in accordance with claim 1, wherein said feed tube is designed for connection to a drinking container or a pressurized gas source.

5. A gas mask in accordance with claim 1, wherein said feed tube comprises a connection end for connection to any one of a drinking container, a pressurized gas source, and an oxygen source.

6. A gas mask in accordance with claim 1, wherein said feed tube is provided with a plug-in connection.

7. A gas mask in accordance with claim 1, wherein:

said connection means, said closing plug and said flexible part are arranged in series to provide the connection of said feed tube to the gas mask when said closing plug is connected to said connection means on said feed tube.

8. A gas mask in accordance with claim 1, wherein:

said connection means provides a connection of said feed tube to the gas mask through said flexible part when said connection means is connected to said closing plug.

9. A gas mask comprising:

a gas mask body with a feed conduit having an opening;

a closing plug connected to said gas mask via a flexible part for directly closing said feed opening;

a feed tube with an insertion portion for insertion into said feed opening; and a connection means on said feed tube for maintaining a connection of said feed tube to said closing plug to provide a mechanical fixation of said feed tube in relation to said gas mask body through said flexible part when said connection means is connected to said closing plug.

10. A gas mask in accordance with claim 9, wherein said connection means is a bead with a hole for receiving said closing plug.

11. A gas mask in accordance with claim 9, wherein a non-return valve is provided in the area of said feed tube.

12. A gas mask in accordance with claim 9, wherein said feed tube is designed for connection to a drinking container or a pressurized gas source.

13. A gas mask in accordance with claim 9, wherein said feed tube comprises a connection end for connection to any one of a drinking container, a pressurized gas source, and an oxygen source.

14. A gas mask in accordance with claim 9, wherein said feed tube is provided with a plug-in connection.

15. A gas mask in accordance with claim 9, wherein:

said connection means is a separate structure than said insertion portion of said feed tube.

16. A gas mask in accordance with claim 9, wherein:

said connection means, said closing plug and said flexible part are arranged in series to provide the mechanical fixation of said feed tube to said gas mask body when said closing plug is connected to said connection means on said feed tube.

17. A gas mask comprising:

a gas mask body with a feed conduit, said gas mask defining a feed opening in communication with said feed conduit;

a closing plug selectively and directly connectable with said feed opening to selectively open and close said feed opening to an environment external to the gas mask;

a flexible part connected to said gas mask body and said closing plug, said flexible part fixing said closing plug to said gas mask body when said closing plug is separated from said feed opening;

a feed tube with an insertion portion insertable into said feed opening, said feed tube providing a fluid passage though said gas mask body when said feed tube is inserted into said feed opening;

a connector on said feed tube selectively connectable to, and disconnectable from, said closing plug;

said connector, said closing plug and said flexible part being arrangeable in series to mechanically fix said feed tube to said gas mask body.

18. A gas mask in accordance with claim 17, wherein:

said connector, said closing plug and said flexible part, in combination, mechanically fix said feed tube to said gas mask body when said closing plug is connected to said connector on said feed tube, and while said feed opening and said feed tube are open to the external environment.

19. A gas mask in accordance with claim 17, wherein:

said connector, said closing plug and said flexible part are arranged to transfer a holding force from said gas mask body to said flexible part, then to said closing plug, then to said connector, and then to said feed tube, when said closing plug is connected to said connector on said feed tube.

20. A gas mask in accordance with claim 17, wherein:

said connector is a separate structure than said insertion portion of said feed tube;

said closing plug directly connects to a portion of said gas mask that defines said feed opening;

said closing plug in said feed opening blocks insertion of said feed tube into said feed opening.

* * * * *